US011035233B2

(12) United States Patent
Gauss et al.

(10) Patent No.: US 11,035,233 B2
(45) Date of Patent: Jun. 15, 2021

(54) VANES FOR THE IMPELLER OF A VENTILATOR, IMPELLER, AND AXIAL VENTILATOR, DIAGONAL VENTILATOR, OR RADIAL VENTILATOR

(71) Applicant: ZIEHL-ABEGG SE, Künzelsau (DE)

(72) Inventors: Tobias Gauss, Niedernhall (DE); Daniel Seifried, Schwäbisch Hall (DE); Thomas Bitz, Künzelsau (DE); Frieder Loercher, Braunsbach (DE); Georg Hofmann, Tauberbischofsheim (DE); Sven Loenne, Obersulm-Willsbach (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 16/631,500

(22) PCT Filed: Jun. 18, 2018

(86) PCT No.: PCT/DE2018/200063
§ 371 (c)(1),
(2) Date: Jan. 16, 2020

(87) PCT Pub. No.: WO2019/015729
PCT Pub. Date: Jan. 24, 2019

(65) Prior Publication Data

US 2020/0173284 A1 Jun. 4, 2020

(30) Foreign Application Priority Data

Jul. 18, 2017 (DE) ..... 10 2017 212 231.5

(51) Int. Cl.
*F01D 5/04* (2006.01)
*F04D 29/30* (2006.01)

(52) U.S. Cl.
CPC ..... *F01D 5/04* (2013.01); *F04D 29/30* (2013.01); *F05D 2240/303* (2013.01); *F05D 2240/304* (2013.01)

(58) Field of Classification Search
CPC ..... F01D 5/04; F04D 29/30; F04D 29/281; F04D 29/384; F05D 2240/303;
(Continued)

(56) References Cited

U.S. PATENT DOCUMENTS

2005/0220613 A1* 10/2005 Yoshida ..... F04D 25/0613 415/206
2006/0228212 A1* 10/2006 Sadi ..... F04D 29/288 415/206
2013/0164488 A1 6/2013 Wood et al.

FOREIGN PATENT DOCUMENTS

CN 102242732 A * 11/2011
CN 104100570 A 10/2014
(Continued)

OTHER PUBLICATIONS

WPI Database, week 201503; Thomson Scientific, London, GB; AN 2015-01402M.

*Primary Examiner* — Jacob M Amick
*Assistant Examiner* — Charles J Brauch
(74) *Attorney, Agent, or Firm* — Jason P. Mueller; FisherBroyles, LLP

(57) ABSTRACT

A disclosed system includes an impeller for a ventilator. The impeller includes a hub or hub ring configured to rotate about an axis and a plurality of vanes attached to the hub or hub ring. Each vane of the impeller has a leading edge facing a pressure side of the ventilator along the axis, and a trailing edge facing a suction side of the ventilator along the axis. The leading edge of each vane has a corrugated shape characterized by a first wavelength and the trailing edge has a corrugated shape characterized by a second wavelength,
(Continued)

Figure 1:
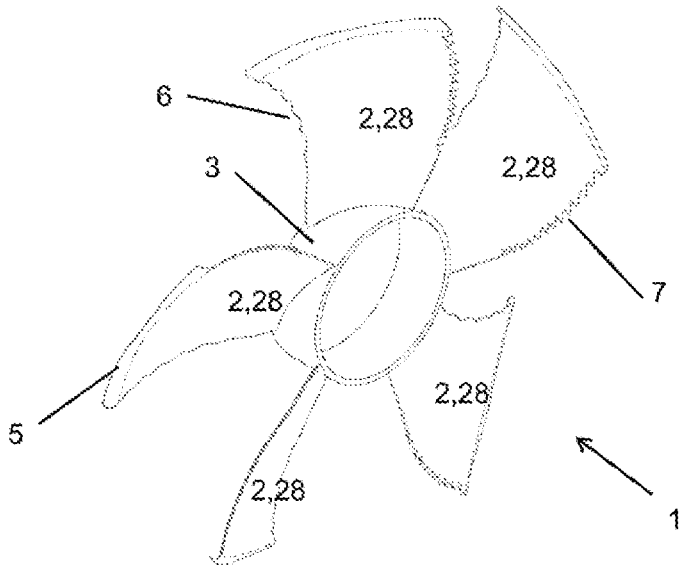

with the first wavelength being longer than the second wavelength. The impeller may further include injection molded plastic, die-cast aluminum, stamped sheet metal, or laser cut sheet metal that is embossed. The impeller may further be assembled from separately manufactured pieces that are secured to one another using joining, welding, or by interlocking tabs.

19 Claims, 9 Drawing Sheets

(58) Field of Classification Search
CPC ..... F05D 2240/304; F05D 2250/184; F05D 2250/181; F05D 2250/182; F05D 2250/183; F05D 2250/611
See application file for complete search history.

(56) References Cited

FOREIGN PATENT DOCUMENTS

| | | | | | |
|---|---|---|---|---|---|
| DE | 102010023017 | A1 | | 12/2011 | |
| DE | 102013216575 | A1 | | 2/2015 | |
| DE | 102015216579 | A1 | | 3/2017 | |
| EP | 2418389 | A2 | * | 2/2012 | ..... F04D 29/384 |
| EP | 2418389 | A2 | | 2/2012 | |
| JP | 2006009699 | A | * | 1/2006 | |
| JP | 2006009699 | A | | 1/2006 | |
| WO | 2017036470 | A1 | | 3/2017 | |

* cited by examiner

VANES FOR THE IMPELLER OF A VENTILATOR, IMPELLER, AND AXIAL VENTILATOR, DIAGONAL VENTILATOR, OR RADIAL VENTILATOR

CROSS-REFERENCE TO RELATED APPLICATIONS

This application is a national stage entry under 35 U.S.C. 371 of PCT Patent Application No. PCT/DE2018/200063, filed Jun. 18, 2018, which claims priority to German Patent Application No. 10 2017 212 231.5, filed Jul. 18, 2017, the entire contents of each of which are incorporated herein by reference.

The disclosure relates to vanes for the impeller of a ventilator, especially an axial ventilator, diagonal ventilator or radial ventilator.

Furthermore, the disclosure relates to an impeller outfitted with such vanes as well as an axial ventilator or diagonal ventilator or radial ventilator each having an impeller outfitted with corresponding vanes.

The providing of ventilators with low noise emission while achieving defined and required air performance (volume flow and pressure increase) as well as efficiency is of fundamental interest to manufacturers of ventilators. In various embodiments, the noise emission should be low in ventilators which are installed in a system.

From EP 2 418 389 A2 there is known an axial fan in itself, having an especially low noise emission in the broadband frequency range, caused by the leakage flow at the head gap, thanks to a special configuration of the fan wheel in the radially outer region of the fan wheel. The special configuration is achieved, for example, in that the profile of the fan vanes in the radially outer region, looking in the span direction, is characterized by a distinct deviation from the profile in the span direction in the other region of the fan vanes. But such a configuration of the fan wheel cannot reduce, or can only inadequately reduce the tonal noise which is caused by inflow perturbations. Likewise, such a configuration cannot reduce, or can only inadequately reduce the trailing edge noise.

From US 2013/0164488 A1 there is known in itself a profiled fan vane which by a special wavy configuration (i.e., having a corrugated shape) of its leading edge in a fan can reduce the tonal noise caused by inflow perturbations.

From WO 17036470 A1 there is known an impeller or vane wheel for an axial ventilator or diagonal ventilator in which both the leading edge and the trailing edge are wavy. At the leading edge and trailing edge there are provided waves with a substantially identical wave length and a substantially identical amplitude. Practice has shown that the tonal noise caused by inflow is considerable, especially at high rotary speed.

The problem which this disclosure proposes to solve is to configure and modify vanes for the impeller of a ventilator, especially an axial ventilator, diagonal ventilator or radial ventilator, in such a way that the acoustics are improved during the operation of such a ventilator, and the noise emission is reduced.

The above problem is solved in regard to the vanes according to the disclosure by the features of claim 1. Accordingly, the vane has a wavy leading edge and a wavy trailing edge, wherein the waves at the leading edge have a larger wave length than the waves at the trailing edge.

It has been discovered that, thanks to the features of claim 1, an improvement in the acoustics is achieved by reduction of the leading edge sound, namely, by an optimization of the leading edge. The provisions at both the leading edge and the trailing edge produce a synergistic effect, at least when the waves at the leading edge have a greater wave length than the waves at the trailing edge. Lastly, there is an optimization of the leading edge by influencing the leading edge geometry in combination with an optimization in the region of the trailing edge.

Specifically, it is advantageous when the wave length of the waves at the leading edge is at least 1.5 times as large as the wave length of the waves at the trailing edge. The wave length of the waves at the leading edge may be larger than the wave length of the waves at the trailing edge by a factor of 2 to 10.

In the exemplary embodiments to be discussed here, 5 to 10 wave peaks are distributed evenly or unevenly across the span at the leading edge. In this example, 5 to 50 waves are distributed evenly or unevenly across the span at the trailing edge, it not being necessary for the waves to extend across the entire leading edge and/or across the entire trailing edge. It is enough for the waves to be formed on a region remote from or facing away from the hub or the hub ring.

In further advantageous manner, the wave length of the waves and/or the amplitude of the waves diminishes at the leading edge from the hub to the vane tip or the cover ring. The wave length of the waves and/or the amplitude of the waves diminishes at the trailing edge from the hub or the hub ring to the vane tip or the cover ring.

Due to the special geometry of the waves at the trailing edge, one may call them "toothlike" (i.e., having tooth shaped structures). Hence, one may call the shapes at the trailing edge teeth, this term being taken in the broadest sense. The teeth at the trailing edge differ from the waves at the leading edge by a smaller wave length relative to the amplitude or the wave/tooth height, and possibly also by steeper flanks and rather pointed wave peaks.

At their free end, the waves or teeth may be more or less sharp edged. For safe handling during installation, it is advantageous for them to be rounded or flattened at their free ends. It is also conceivable for the teeth to be coated there with a protective film, an enamel, etc.

The disclosure relates primarily to the configuration of the vane leading edge and trailing edge. It is of further advantage when the vanes are twisted three dimensionally, but not in themselves wavy (i.e., the vanes may have a smooth surface). This provision also reduces the sound emission.

Insofar as the vane is intended for an axial or diagonal ventilator, it is further advantageous for the vane tips to be outfitted with so-called winglets, namely, with bends or roundings at the ends, curving from the pressure side to the suction side. This provision also provides reduced sound emission and may boost the performance.

As already mentioned, the waves—both at the leading edge and at the trailing edge—extend at least across a portion of the vane span. It is also conceivable for the waves to be fashioned zonally or in groups with different wave length and/or different amplitude.

The vane can be made of various materials, such as sheet metal. In the context of such an embodiment, it is advantageous for at least the trailing edge region to be enameled or powder-coated, namely, in the area of the teeth.

The vane in one especially simple design/embodiment can be made of plastic by injection molding or of aluminum by die-casting. If the vane is a sheet metal part, this may be made by stamping or by laser cutting and then assembled into a complete impeller by embossing and joining/welding, interlocking, etc., which can then be implemented in an axial ventilator, diagonal ventilator or radial ventilator. The impellers are configured and manufactured according to the requirements, with the vanes in the impeller for an axial ventilator extending from a hub outwardly to a free end.

In the event that they are implemented in a radial ventilator, the vanes extend between a hub ring and a cover ring and are joined firmly to the hub ring and the cover ring. In regard to the configuration of the leading edge and trailing edge, the same embodiments are applicable as in the aforementioned ventilator types, especially when it is a primary question of reducing the sound emission, for example, the reduction of the leading edge and trailing edge sound, by provisions involving both the leading edge and the trailing edge.

Figure 12:
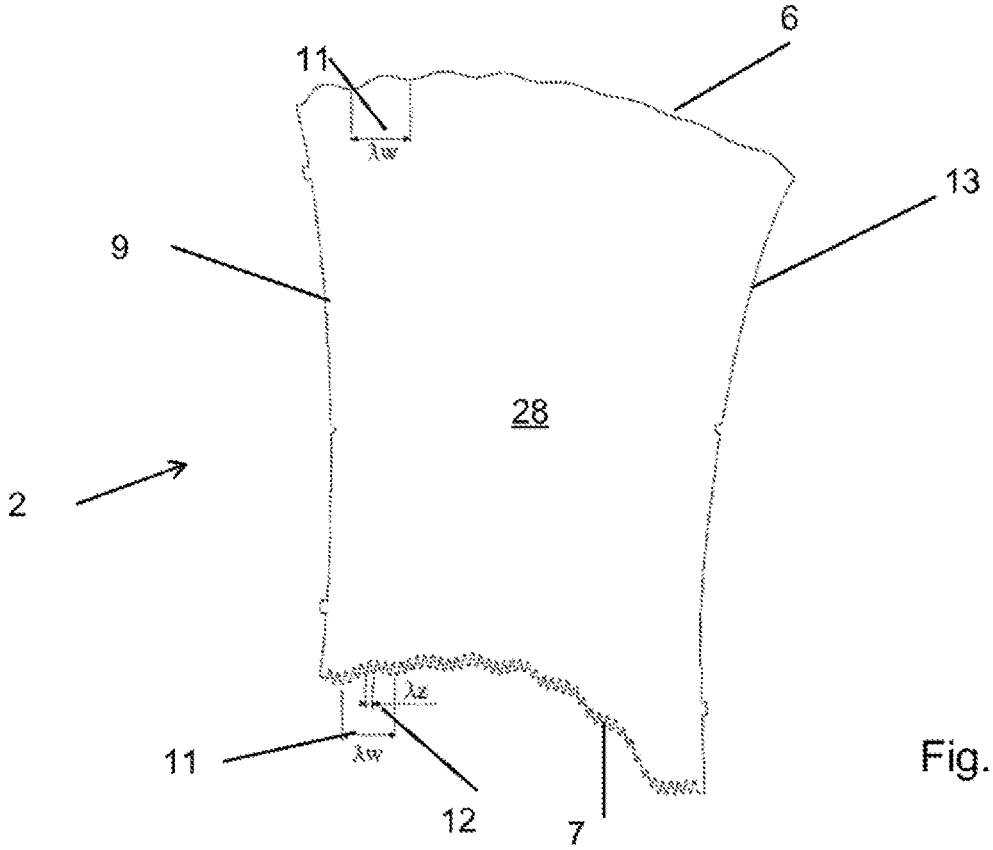
Figure 13:
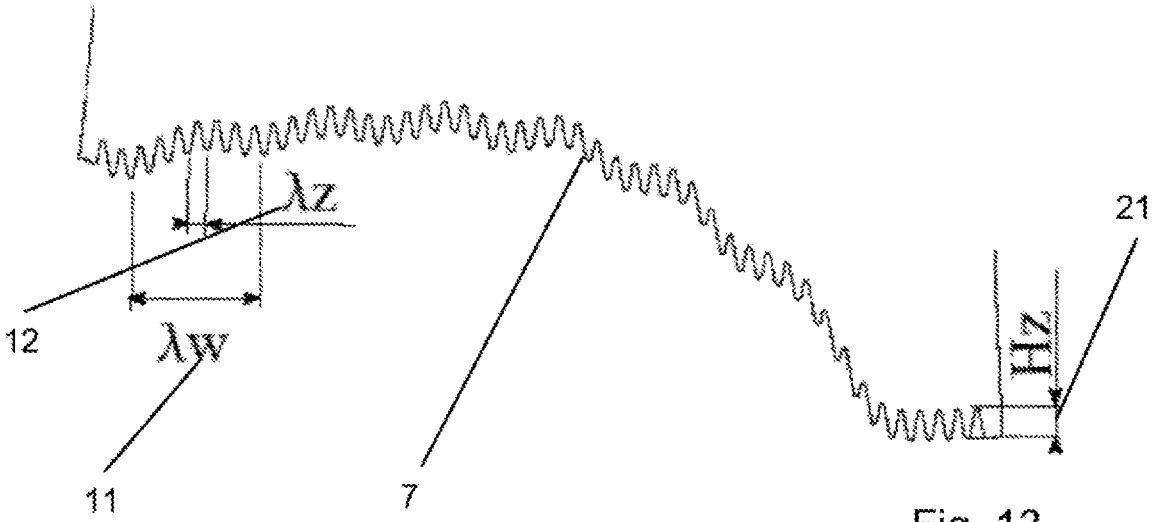

Now, there are various possibilities for embodying and modifying the teaching of this disclosure in advantageous manner. For this, on the one hand refer to the claims coming after claim 1 and on the other hand to the following explanation of exemplary embodiments of the vane according to the disclosure or an impeller according to the disclosure with the aid of the drawing. In connection with the explanation of the exemplary embodiments of the disclosure with the aid of the drawing, embodiments and modifications of the teaching will also be discussed in general. The drawing shows FIG. 1 in perspective front view, an exemplary embodiment of an impeller of axial design according to the disclosure, FIG. 2 in axial top view, looking from the outflow side, the impeller of FIG. 1, FIG. 3 in axial top view, looking from the inflow side, the impeller of FIGS. 1 and 2, FIG. 4 in axial top view, looking from the outflow side, a vane of the exemplary embodiment of FIGS. 1 to 3 with schematic representations, FIG. 4*a* a detail view of FIG. 4 regarding the vane trailing edge region, FIG. 4*b* a detail view of FIG. 4 regarding the vane leading edge region, FIG. 5 a graphic representation of the sonic power level of a ventilator with impeller according to the disclosure as compared to conventional systems, FIG. 6 in perspective front view, an exemplary embodiment of an impeller of radial design according to the disclosure, FIG. 7 in a side view, the exemplary embodiment of FIG. 6, FIG. 8 an individual vane of the exemplary embodiment of FIGS. 6 and 7, seen from the suction side, FIG. 9 the vane of FIG. 8, in a perspective front view, FIG. 10 a detail front view of the impeller of FIGS. 6 and 7, seen from the side, FIG. 11 a vane of another exemplary embodiment, seen from the suction side, with centering provisions, the vane being represented in a developed view, FIG. 12 the vane of FIG. 11 with representations of the wave lengths, the vane being represented in a developed view, FIG. 13 a detail front view of FIG. 12, showing the vane trailing edge region, FIG. 14 a detail front view similar to FIG. 13, showing the vane trailing edge region, representing a three dimensionally embossed vane, FIG. 15 a detail front view, in cross section and seen from the side, of the impeller of FIGS. 6 and 7.

FIG. 1 shows in perspective front view an impeller 1 according to the disclosure for an axial ventilator. On a hub 3 there are arranged five vanes 2. Other numbers of vanes are also conceivable for such an impeller, advantageously three to nine vanes. The impeller 1 is made of fiber-reinforced plastic by injection molding. Other manufacturing methods are also conceivable, for example aluminum die-casting or a welded sheet metal design. In the exemplary embodiment, the impeller 1 is shown as a single-piece impeller—but it may also be assembled from individual vanes with a hub, or it may be a complete die cast rotor, parts of the rotor of the motor being joined to the impeller as a single piece.

The vanes 2 include a leading edge region 6 and a trailing edge region 7. The vane leading edge regions 6 and the vane trailing edge regions 7 each time join the pressure sides 28 of the vanes 2 and the suction sides 29 of the vanes 2, which can be seen in FIG. 3. At the radially outer end, there is formed a vane tip 5. One will notice a waviness at the leading edge region 6 of the vane 2, around seven wave peaks being distributed unevenly across the span. At the trailing edge region 7 there is likewise formed a waviness, the waviness at the trailing edge being toothlike. The wave length of the waviness at the trailing edge region 7 has a distinctly smaller wave length than the waviness at the leading edge, being smaller at least by a factor of 1.5. In the exemplary embodiment, thirteen wave peaks or teeth are distributed across the span at the trailing edge region 7.

Figure 2:
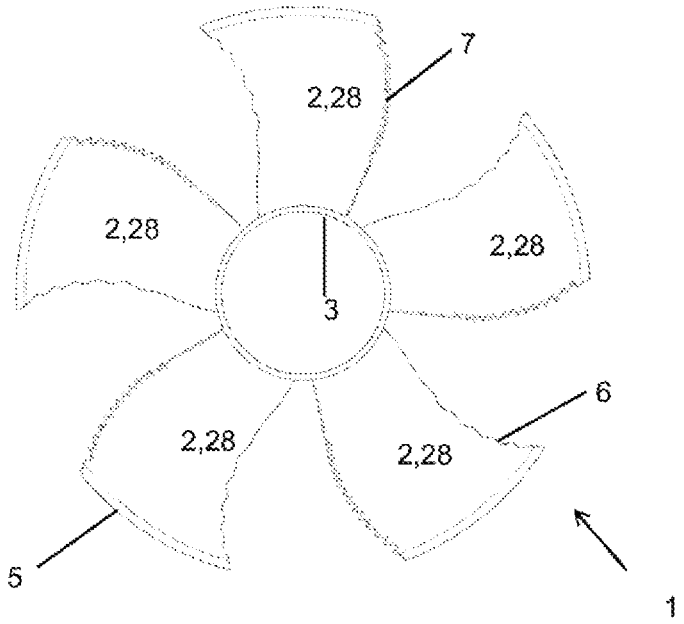

FIG. 2 shows the exemplary embodiment of FIG. 1 in an axial top view, seen from the outflow side. The vanes 2 have a three-dimensional twisted shape, but are not in themselves wavy, that is, a flat cross section through such a vane 2 would have no waviness. The waviness can be seen at the leading edge region 6 and, in toothed profile, at the trailing edge region 7. The vane tips 5 have winglets, which are curved from the pressure side to the suction side, in order to further improve the acoustics. One also notices in this representation that the wave length of the waviness of the leading edge region 6 is distinctly larger than that of the trailing edge region 7, advantageously by a factor of around two to ten times. This ratio has proven to be especially advantageous for achieving a low noise level. Both low tonal noise levels due to inflow perturbations and a low trailing edge noise are achieved. The interaction between the waviness at the leading edge region 6 with the large wave lengths and rather smaller amplitudes and the waviness at the trailing edge region 7 with the small wave lengths and rather large amplitudes, thereby appearing to be somewhat toothlike, results in a low overall sound of a ventilator with such an impeller 1.

Figure 3:
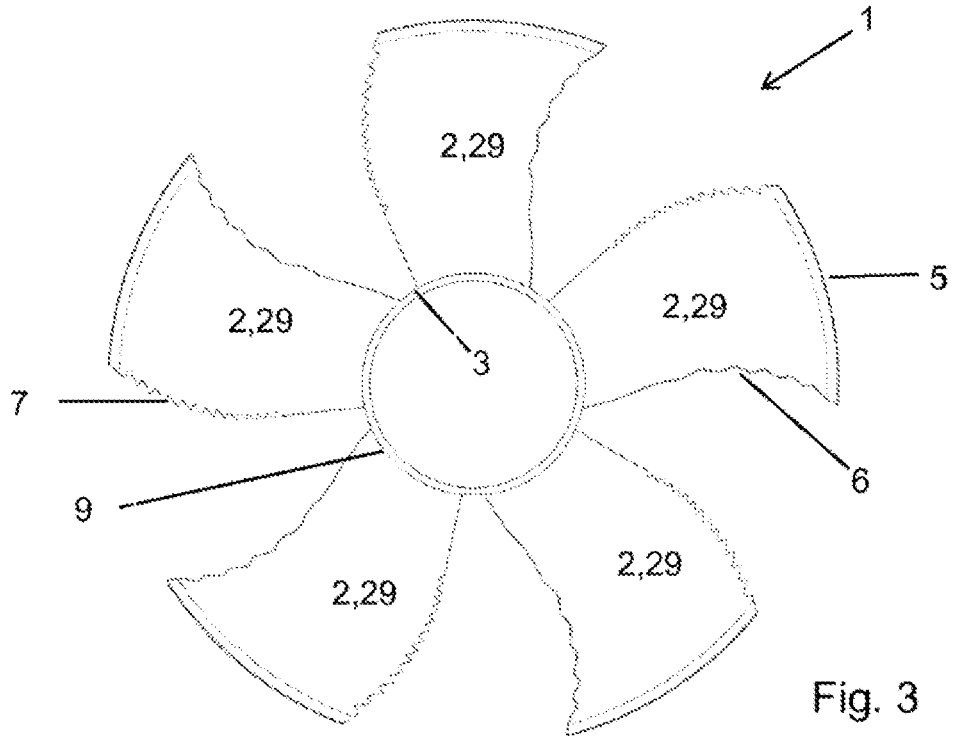

FIG. 3 shows the exemplary embodiment of FIG. 1 and FIG. 2 in an axial top view, looking from the inflow side. One notices in this view the suction sides 29 of the vanes 2. The direction of rotation of the impeller 1 in this view is clockwise. The vane tips 5 at the vane leading edge regions 6 precede the vanes 2 in the direction of rotation, the vanes 2 being forward sickled. This is advantageous for low noise level and pressure stability, especially in a radially outer region. The wavy, toothlike vane trailing edge region 7 has a sharp separation edge at the transition to the vane suction side 29, which is especially advantageous for low trailing edge noise.

Figure 4:
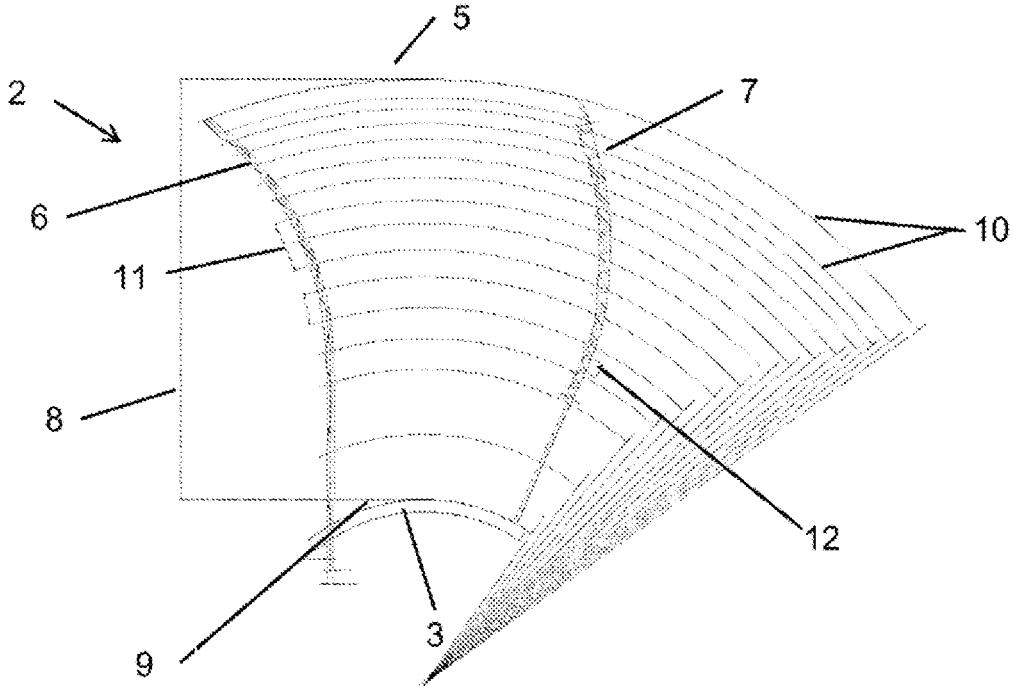

FIG. 4 shows, in an axial top view, looking from the outflow side, a vane 2 of the impeller of FIGS. 1 to 3 with additional details shown schematically. The partial diameter 10 is indicated for each wave peak and each wave valley of the waves at the leading edge region 6 of the vane 2. The wave length 11 ($\lambda w$) of the wavy leading edge region 6 increases from the vane tip 5 (at the outer diameter $R_A$) to the hub 2 (at the hub diameter $R_N$). The wave length 12 ($\lambda z$) of the wavy or toothlike trailing edge region 7 is smaller by a factor of 1.5 to 3 than the wave length 11 (λw) of the wavy leading edge region 6 and decreases from the vane tip 5 to the hub 2. One also notices that the trailing edge region 7 is not wavy or toothlike in a region near the hub 3.

Figure 4A:
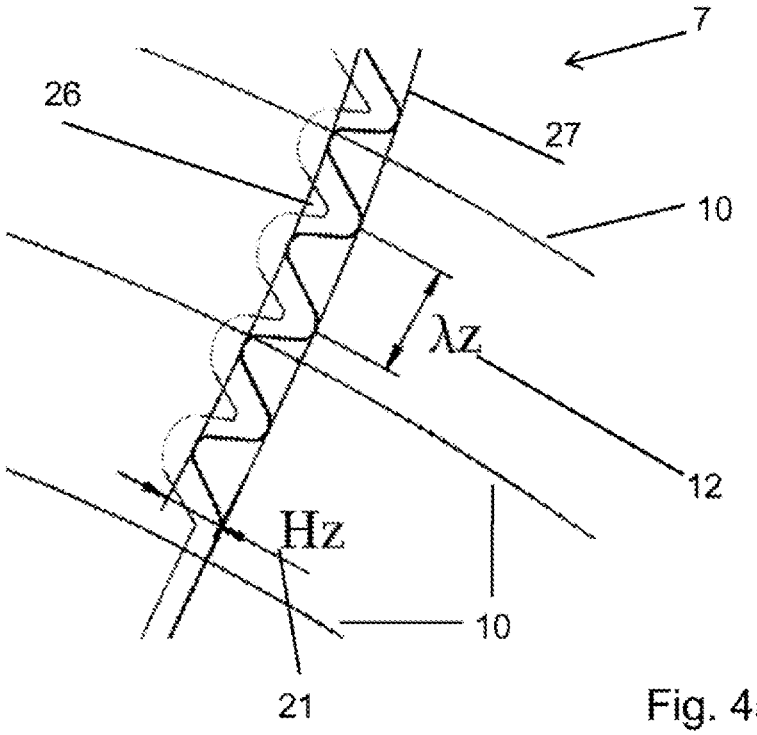

FIG. 4*a* shows a detail of FIG. 4 at the vane trailing edge region 7. A wave length 12 (λz) of the waviness of the vane trailing edge region 7 is indicated, which can be measured from wave peak to wave peak or from wave valley to wave valley. The wave length 12 (λz), as in the example shown, may be variable across the span profile of the vane trailing edge region 7. Furthermore, there is indicated the height 21 (Hz) of the waves or teeth at the vane trailing edge region 7. This corresponds to roughly twice the amplitude of a waviness. Hz can also vary across the span profile of the vane trailing edge region 7, but in the exemplary embodiment it is advantageously approximately constant over a broad region. A relatively small fillet radius <0.3*Hz is formed at the wave peaks in the vane trailing edge region 7, so that this waviness appears quite toothlike.

Figure 4B:
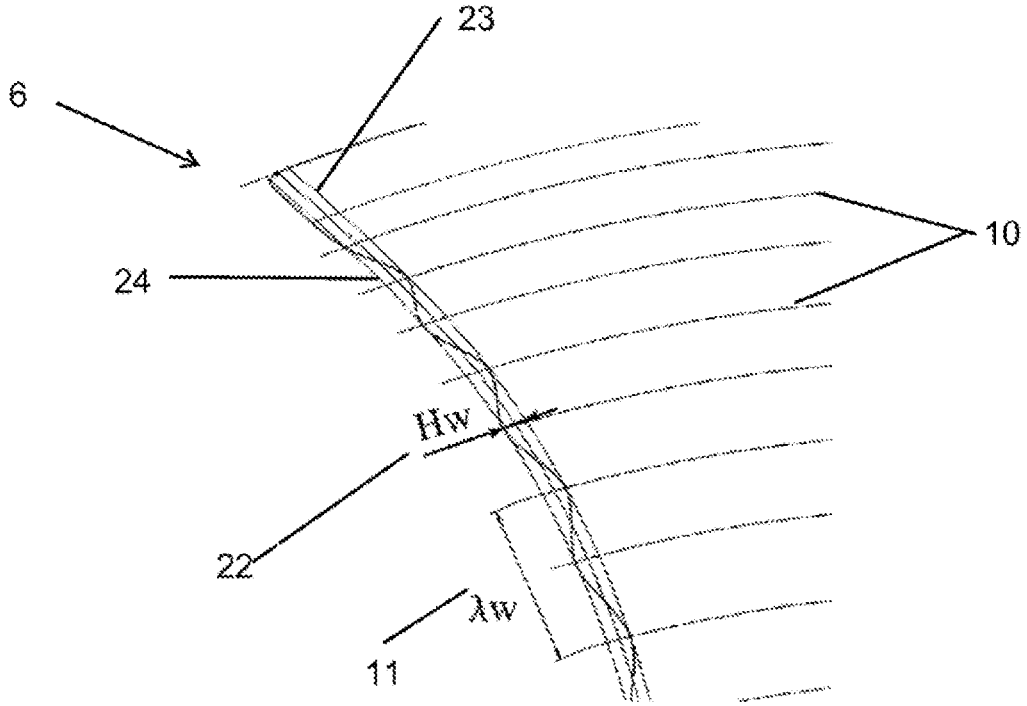

FIG. 4*b* shows a detail of FIG. 4 at the vane leading edge region 6. There is indicated a wave length 11 (λw) of the waviness of the vane leading edge region 6, which can be measured from wave peak to wave peak or from wave valley to wave valley. The wave length 11 (λw) in the exemplary embodiment is variable across the span profile of the vane leading edge region 6. Furthermore, the height or double amplitude 22 (Hw) of the waves at the vane leading edge region 6 is indicated.

This corresponds roughly to twice the amplitude of a waviness. The wave peaks can be joined by a line 24, for example in an axial view as in FIG. 4*b*, and the wave valleys by a line 23. The spacing between these two lines corresponds roughly to Hw, which in the exemplary embodiment is roughly constant across the span profile of the vane leading edge region 6.

Figure 5:
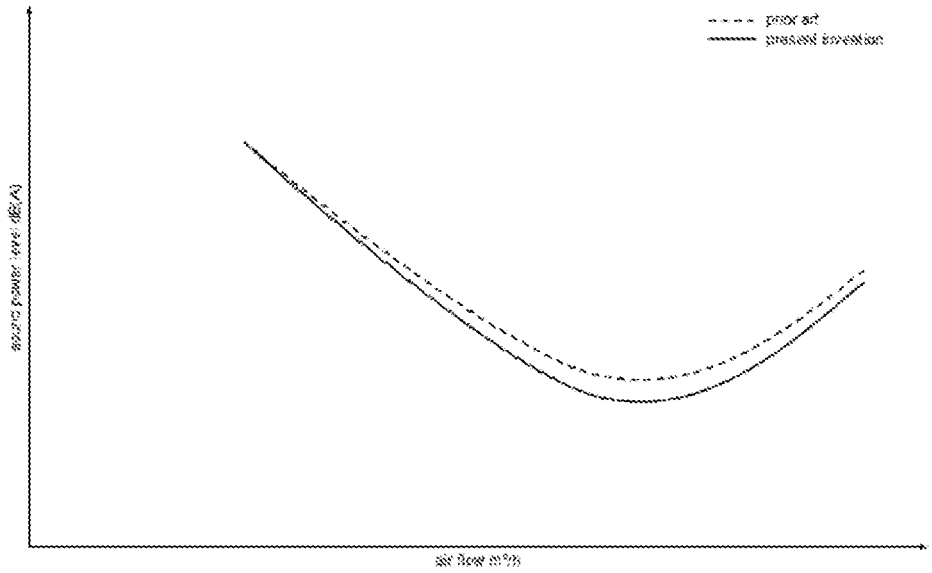

FIG. 5 shows in a graph the sonic power level of a ventilator with an impeller according to the disclosure as compared to an impeller having only a conventional toothlike trailing edge, at constant rotary speed and variable volume flow. The sonic power level is significantly reduced by the configuration according to the disclosure over a broad range of volume flows.

Figure 6:
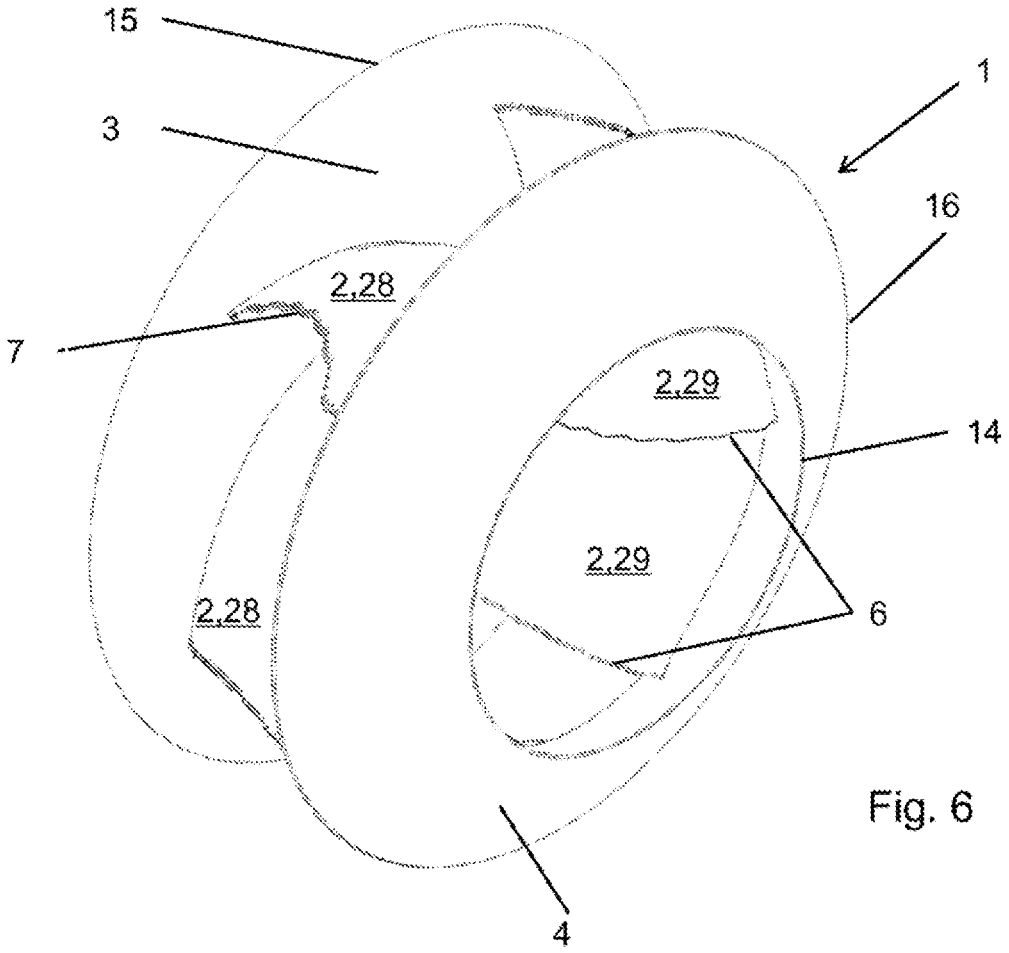

FIG. 6 shows in perspective view an exemplary embodiment of an impeller 1 of a radial ventilator according to the disclosure. This exemplary embodiment is made of sheet metal. The five vanes 2 are made of sheet metal by laser cutting and embossing. They are welded to the hub 3 and the cover ring 4. One can see a waviness at the leading edge region 6 of the vane 2 from the silhouette line, roughly eight wave peaks being evenly distributed across the span. At the vane trailing edge region 7, a wavy, rather toothlike configuration can be seen, being superimposed on a second waviness, comparable in wave length and wave amplitude to the waviness of the leading edge region 6. There are roughly 48 waves or teeth distributed across the span in the trailing edge region 7. It is especially advantageous to have distinctly more waves or teeth at the vane trailing edge region 7 than the waves at the vane leading edge region 6, being six times as many in the exemplary embodiment, and advantageously two to ten times as many.

Figure 7:
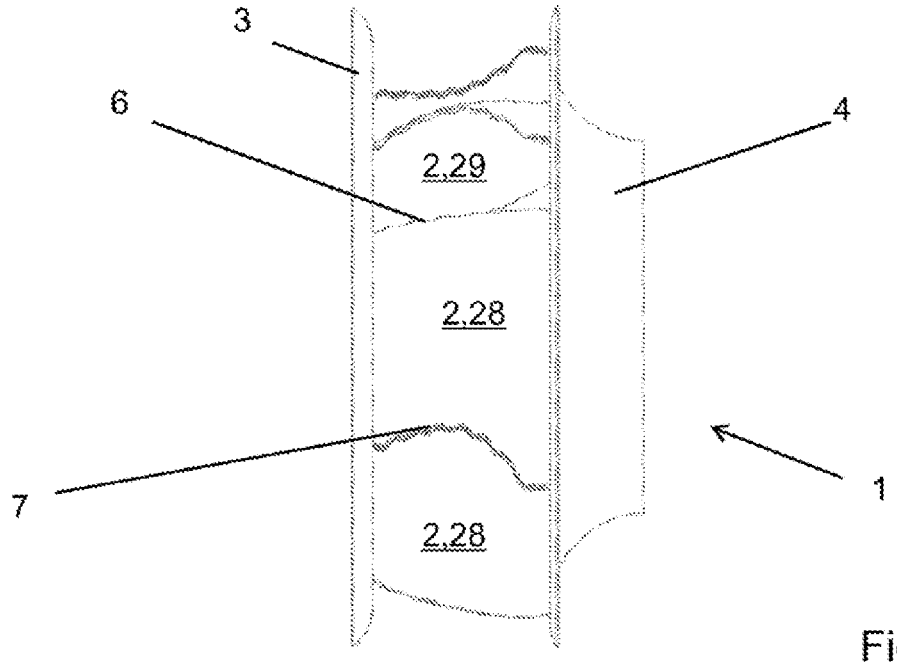

FIG. 7 shows in a side view the exemplary embodiment of FIG. 6. It consists of a hub 3, 5 vanes 2 and a cover ring 4. The cover ring 4 has an air inlet opening (right), through which air is sucked in during the operation of the ventilator. The vanes 2 have a three-dimensional twisted shape. For example, the vane pressure sides 28 and the vane suction sides 29 do not run parallel to the axis of rotation of the impeller 1 across broad regions. Such a three-dimensional configuration is advantageous to the air performance, the efficiency, and the acoustics of a ventilator with the impeller 1. The slender teeth or waves at the trailing edge regions 7 can be clearly seen. The waviness at the leading edge regions 6 can be seen. This has a significantly larger wave length than the toothlike waviness at the vane trailing edge region 7.

Figure 8:
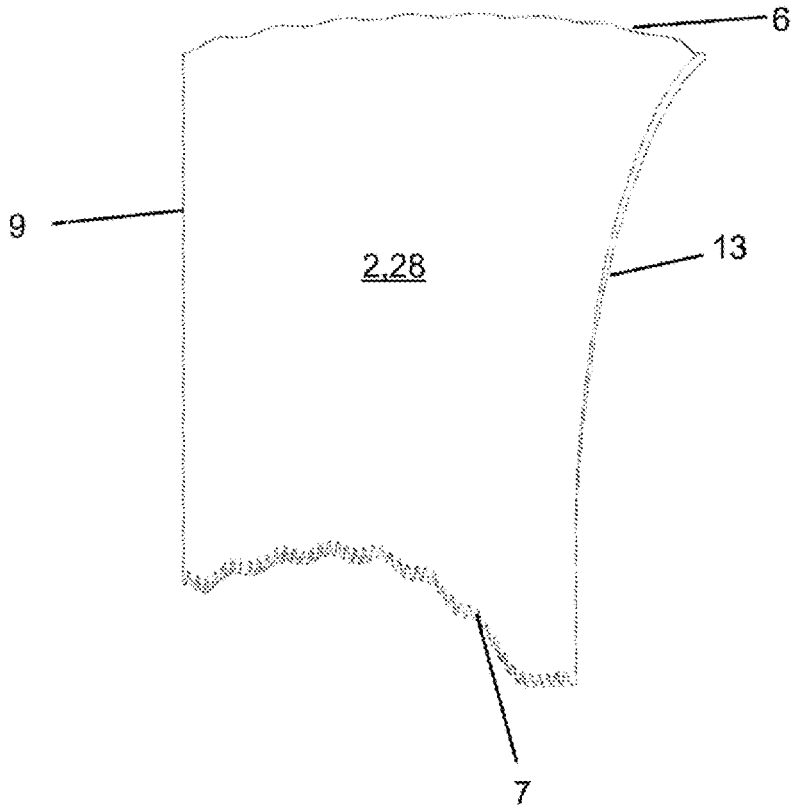

FIG. 8 shows an individual vane 2 of the exemplary embodiment of FIGS. 6 and 7, seen from the pressure side 28. The vane 2 in the exemplary embodiment is made of sheet metal in two stages: laser cutting and embossing. It has a wavy leading edge region 6 and a wavy or toothlike trailing edge region 7. The waviness at the leading edge region 6 produces a reduction in the blade passing noise due to inflow perturbations. The toothlike waviness at the trailing edge region 7 produces a reduction or prevention of trailing edge noise. In sheet metal vanes fabricated in this way, the realization of a thin trailing edge is often expensive, so that the technology of reduction of the trailing edge sound by a wavy or toothlike configuration is especially well suited here. Thanks to the combination with the wavy leading edge region 6, a relatively quiet ventilator results. In this embodiment, the vanes 2 are welded to the hub 3 and the cover ring 4. Other connections are also conceivable (e.g., tabs). In general, it is also conceivable to fabricate one-piece or multiple-piece impellers according to the disclosure by injection molding from plastic.

Figure 9:
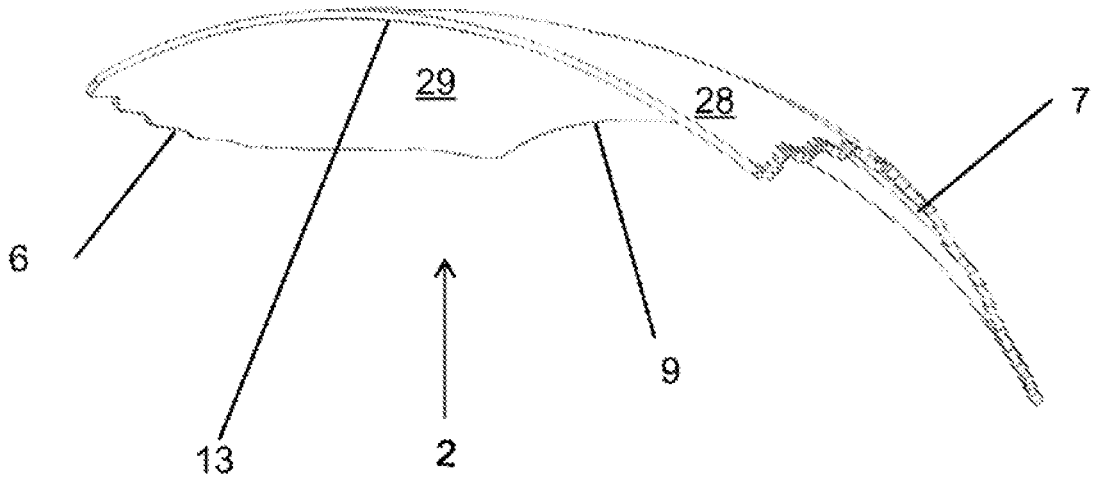

FIG. 9 shows the vane 2 of FIG. 8 in a perspective view. The overall surfaces of the pressure sides 28 and suction sides 29 of the vanes 3 in this embodiment have a waviness which is embossed in the sheet metal vane. The three-dimensional twisted configuration is quite evident. Thanks to the three-dimensional twisted configuration and the embossed waviness, the vane 2 is furthermore stiffened, i.e., the embossed waviness has advantageous impact on the strength and shape stability of the vane 2.

Figure 10:
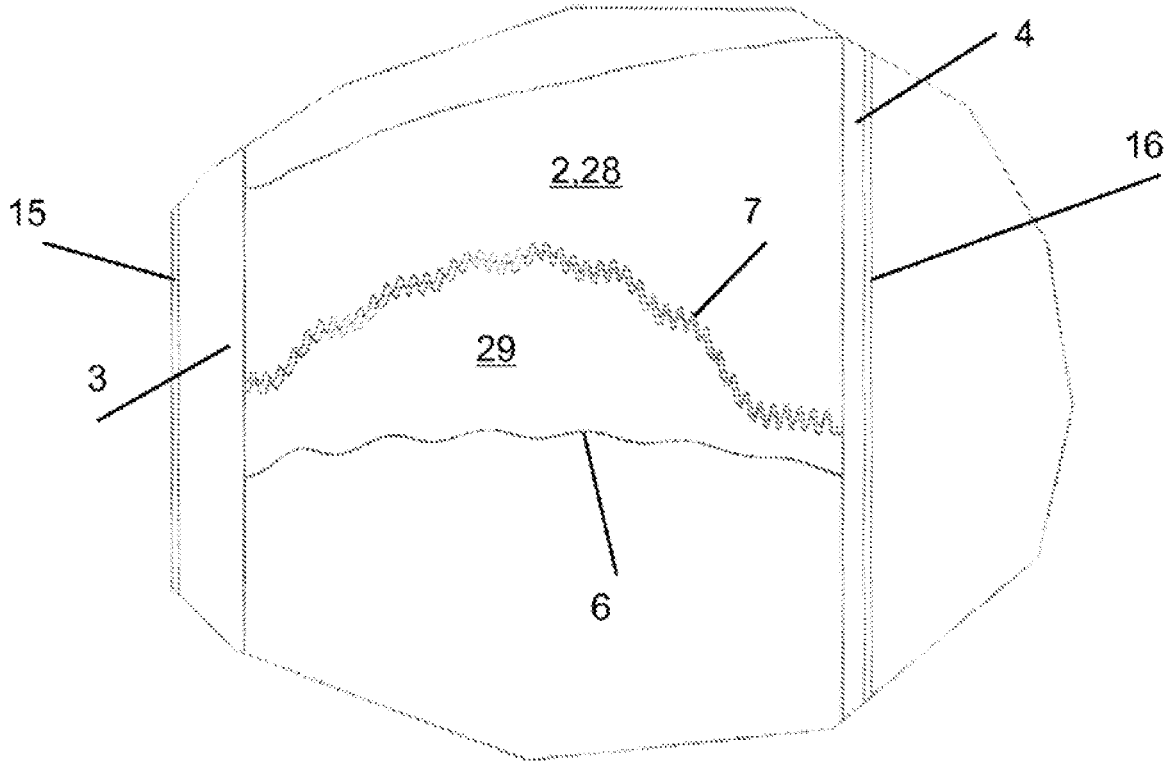

FIG. 10 shows a detail view of the impeller 1 of FIGS. 6 and 7, seen from the side. It is quite evident that the wave lengths of the waves or teeth at the trailing edge region 7 are significantly smaller than the wave lengths of the waviness at the leading edge region 6, namely, by a factor of around 6 in the exemplary embodiment.

Figure 11:
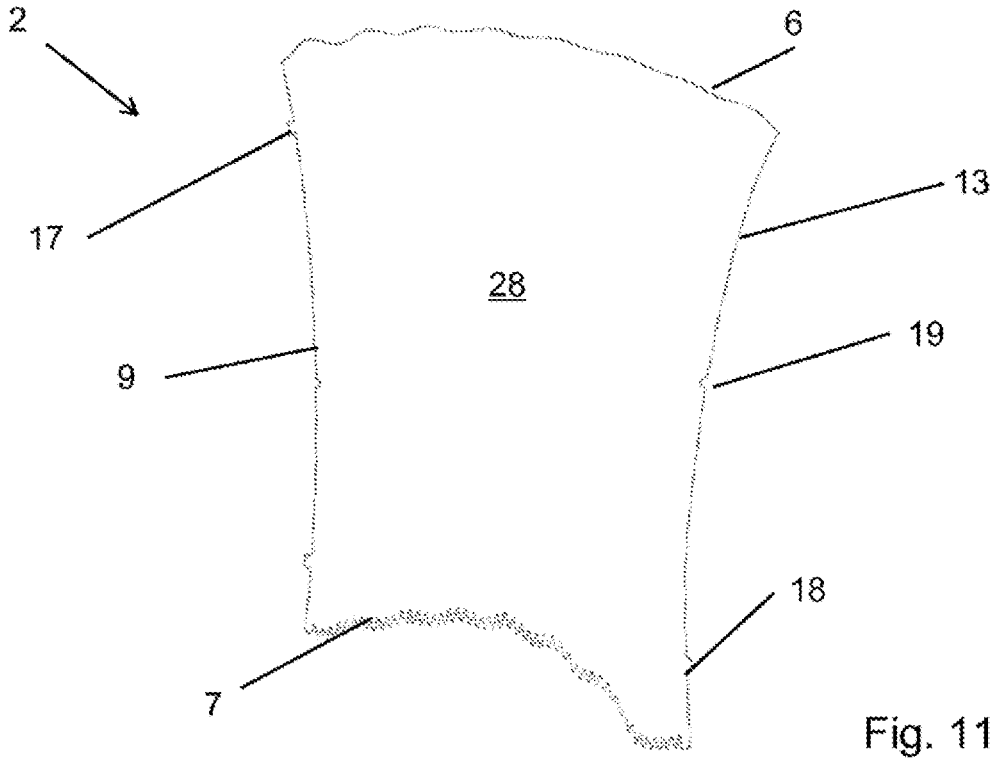

FIG. 11 shows the vane 2 of a further exemplary embodiment, seen from the pressure side 28, and having centering provisions, the vane 2 being shown in a developed view, i.e., as a cut piece of sheet metal prior to the embossing. The finished vane 2 is produced by embossing from this cut piece of sheet metal. The wavy/toothlike profile of the trailing edge region 7 is already clearly evident in the cut piece. The embossing die does not have the teeth of the trailing edge region 7, since they are already present in the cut piece. This is an advantage, since these slender structures do not need to be formed in the embossing tool. The waviness of the leading edge region 6 is already evident on the flat cut piece. Various centering devices 18, 19 are present at the end 9 of the vane 2 on the hub side and at the end 13 of the vane 2 on the cover ring side. The semicircular centering devices 19 roughly at the center serve for the placement of the vane 2 in the embossing tool, and the angular centering devices 18 serve for the placement of the vane 2 in regard to the hub and cover ring in the welding process.

FIG. 12 shows the vane 2 of FIG. 11 with representations of the wave lengths, showing the vane, as in FIG. 11, as a cut piece of sheet metal prior to the embossing. One wave length 11 (λw) at the vane leading edge region 6 and one wave length 12 (λz) at the vane trailing edge region 7 are indicated. The wave length 11 (λw) in this exemplary embodiment superimposed at the vane trailing edge region 7 on the wave length 12 (λz) is also evident, since the wave length 11 (λw) is pronounced over the entire vane 2 and its pressure side 28 and suction side 29 (see FIG. 15). The smaller wave length of the teeth at the trailing edge region 7 is denoted by λz. In the exemplary embodiment, λw is around 6 times λz, advantageously the factor is 2-10.

FIG. 13 shows a detail view of FIG. 12 regarding the vane trailing edge region 7. The height 21 (Hz) of the waves or teeth at the vane trailing edge region 7 is advantageously at least as large as the wave length 12 (λz) of the waves or teeth at the vane trailing edge region 7, advantageously at least 1.4*λz. The teeth or waves at the vane trailing edge region 7 thus have a relatively large height as compared to their wave length. Once again, λz is advantageously not more than 2 times the sheet metal thickness, especially in the case of sheet metal vanes, or the thickness of the vane 2 at its trailing edge region 7 is advantageously not more than 1.5 times this thickness, in order to minimize the sound level of a ventilator having an impeller with vanes 2 by the interaction with the wavy shaped vane leading edge region 6.

Figure 14:
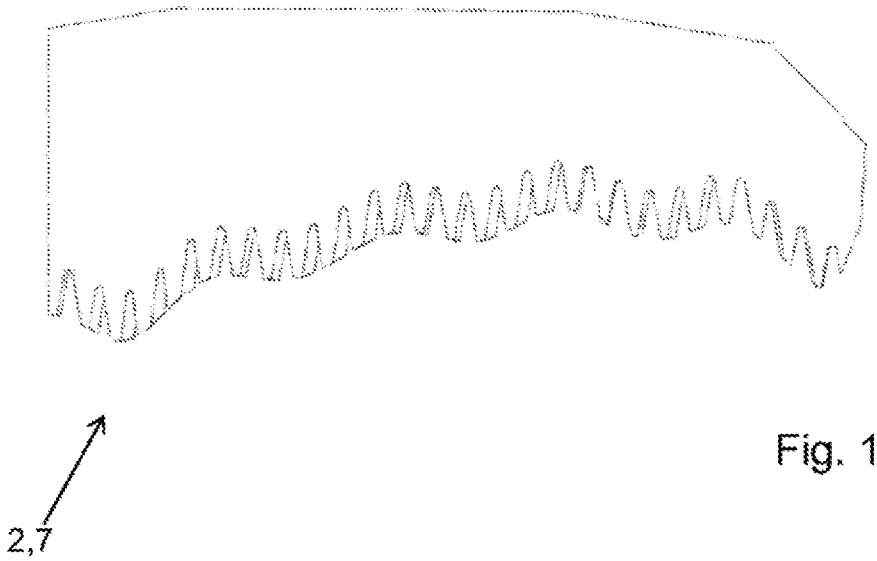

FIG. 14 shows a detail view similar to FIG. 13, regarding the vane trailing edge region 7, representing a portion of a three-dimensionally embossed vane 2. The waves or teeth are not pointed at their outer end (wave peak), but instead flattened. This reduces the risk of damaging the teeth or the risk of injury when handling the impeller 1. Sheet metal vanes with wavy/toothlike trailing edge regions 7 are advantageously powder-coated or enameled. This will blunt the pointed edges and further reduce the risk of injury.

Figure 15:
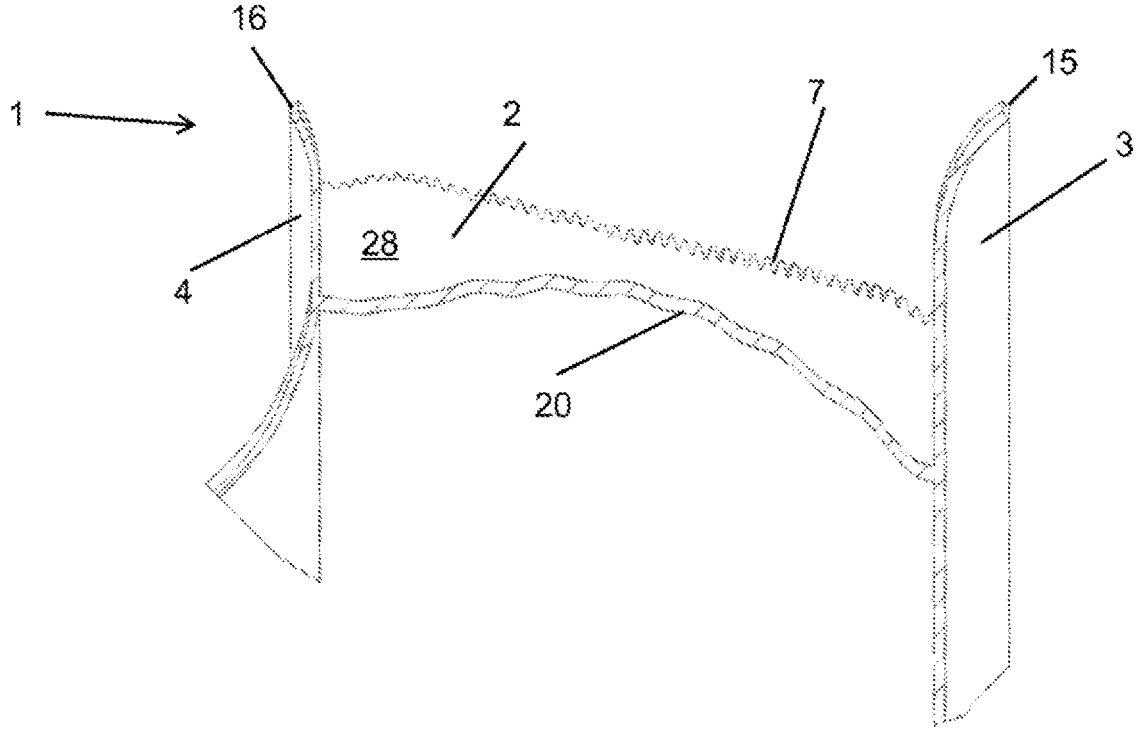

FIG. 15 shows a detail view in cross section and looking from the side of the impeller 1 of FIGS. 6 and 7. The vane 2 extends between the hub 3 and the cover ring 4. The outflow end 16 of the cover disk and the outflow end 15 of the bottom disk is curved in such a way that the exit area of the impeller 1 is enlarged, which can boost the static efficiency. In the cross section 20 through the vane 2, which has a waviness, it is quite evident that the vane 2 has a waviness at least over broad regions of its extension. The vane pressure side 28 and the unseen vane suction side 29 have this waviness. The wave length of this waviness of the vane pressure side 28 and the vane suction side 29 is equal or similar to the wave lengths of the vane leading edge regions 6. The waviness may continue into the vane trailing edge regions 7, where it then appears superimposed on the waves/teeth of the vane trailing edge regions 7, having a distinctly smaller wave length.

LIST OF REFERENCE NUMBERS

1 Impeller
2 Vane
3 Hub/hub ring
4 Cover ring
5 Vane tips, winglets
6 Vane leading edge region
7 Vane trailing edge region
8 Vane span
9 Vane end at hub side
10 Partial diameter, span position
11 Wave length leading edge λw
12 Wave length trailing edge λz
13 Vane end at cover ring side
14 Inflow opening
15 Outflow end of hub/hub ring
16 Outflow end of cover ring
17 Vane/hub centering device
18 Vane/cover ring centering device
19 Vane centering device for embossing tool
20 Cross section through vane
21 Height Hz of teeth/waves at trailing edge region, double amplitude
22 Height Hw of teeth/waves at leading edge region, double amplitude
23 Line of wave valleys at leading edge region
24 Line of wave peaks at leading edge region
25 Center line of waves at leading edge region
26 Line of wave valleys at trailing edge region
27 Line of wave peaks at trailing edge region
28 Vane pressure side
29 Vane suction side

The invention claimed is:

1. An impeller of a ventilator, the impeller comprising:
a hub or hub ring configured to rotate about an axis; and
a plurality of vanes attached to the hub or hub ring,
wherein each vane has a leading edge facing a suction side of the vanes, and a trailing edge facing a pressure side of the vanes,
wherein the leading edge has a corrugated shape characterized by a first wavelength and the trailing edge has a corrugated shape characterized by a second wavelength,
wherein the first wavelength is longer than the second wavelength, and
wherein the corrugated shape of the trailing edge includes teeth shaped structures.

2. The impeller of claim 1, wherein the first wavelength is at least 1.5 times as large as the second wavelength.

3. The impeller of claim 1, wherein the corrugated shape of the leading edge includes 5 to 10 wave peaks that are distributed evenly or unevenly across the leading edge.

4. The impeller of claim 1, wherein the corrugated shape of the trailing edge includes 10 to 50 wave peaks that are distributed evenly or unevenly across the trailing edge.

5. The impeller of claim 1, wherein the leading edge of each vane extends from the hub or hub ring to a vane tip or cover ring, and
wherein the first wavelength and/or an amplitude of the corrugated shape of the leading edge increases along the leading edge from the hub or the hub ring to the vane tip or the cover ring.

6. The impeller of claim 1, wherein the trailing edge of each vane extends from the hub or hub ring to a vane tip or cover ring, and
wherein the second wavelength and/or an amplitude of the corrugated shape of the trailing edge decreases along the trailing edge from the hub or the hub ring to the vane tip or the cover ring.

7. The impeller of claim 1, wherein the teeth shaped structures each include a free end that is rounded or flattened.

8. The impeller of claim 1, wherein each vane has a twisted shape that extends in three dimensions.

9. The impeller of claim 1, wherein the vanes are configured to function in an axial or diagonal ventilator,
wherein each vane extends from the hub or hub ring to a vane tip, and
wherein each vane tip further includes winglets that are curved from the pressure side to the suction side.

10. The impeller of claim 1, wherein the corrugated shapes of the leading and trailing edges each extend across respective portions of the leading edge and the trailing edge.

11. The impeller of claim 1, wherein the vanes are made of sheet metal.

12. The impeller of claim 1, wherein the vanes are made of plastic, of aluminum, or of sheet metal.

13. The impeller of claim 1, wherein the impeller includes at least two vanes and the vanes are manufactured individually or the entire impeller is manufactured as a single piece, wherein the impeller further comprises:

injection molded plastic;

die-cast aluminum;

stamped sheet metal;

laser cut sheet metal that is embossed, and/or wherein the impeller is assembled from separately manufactured pieces that are secured to one another using joining, welding, or by interlocking tabs.

14. An axial ventilator or diagonal ventilator, the axial or diagonal ventilator comprising:

a hub configured to rotate about an axis; and a plurality of vanes attached to the hub, wherein each vane has a leading edge facing a suction side of the vanes, and a trailing edge facing a pressure side of the vanes, wherein the leading edge has a corrugated shape characterized by a first wavelength and the trailing edge has a corrugated shape characterized by a second wavelength, wherein the first wavelength is longer than the second wavelength, and wherein the corrugated shape of the trailing edge includes teeth shaped structures.

15. A radial ventilator, comprising a hub ring;

a cover ring; and an impeller extending between the hub ring and the cover ring, and configured to rotate about an axis, the impeller further comprising:

a plurality of vanes extending between the hub ring and the cover ring, wherein each vane has a leading edge facing a suction side of the vanes, and a trailing edge facing a pressure side of the vanes, wherein the leading edge has a corrugated shape characterized by a first wavelength and the trailing edge has a corrugated shape characterized by a second wavelength, wherein the first wavelength is longer than the second wavelength, and wherein the corrugated shape of the trailing edge includes teeth shaped structures.

16. The impeller of claim 2, wherein the first wavelength is larger than the second wavelength by a factor of 2 to 10.

17. The impeller of claim 11, wherein the vanes are coated with enamel or are powder-coated at least on the trailing edge.

18. The impeller of claim 12, wherein the vanes are made of injection molded plastic, or are made die-cast aluminum, or are made of stamped sheet metal.

19. The impeller of claim 13, wherein the impeller includes a number of vanes that is greater than or equal to three and is less than or equal to nine.

* * * * *